US008444775B2

(12) United States Patent
Crombie, III et al.

(10) Patent No.: US 8,444,775 B2
(45) Date of Patent: May 21, 2013

(54) MANUFACTURING SHAPE MEMORY ALLOY TUBES BY DRAWING

(75) Inventors: Edwin Alfred Crombie, III, West Chester, PA (US); William Andrew Hochella, Coatesville, PA (US)

(73) Assignee: Johnson Matthey Public Limited Company, London (GB)

( * ) Notice: Subject to any disclaimer, the term of this patent is extended or adjusted under 35 U.S.C. 154(b) by 428 days.

(21) Appl. No.: 12/680,945

(22) PCT Filed: Sep. 26, 2008

(86) PCT No.: PCT/GB2008/050871

§ 371 (c)(1),
(2), (4) Date: Jun. 3, 2010

(87) PCT Pub. No.: WO2009/044186

PCT Pub. Date: Apr. 9, 2009

(65) Prior Publication Data

US 2010/0282370 A1 Nov. 11, 2010

(30) Foreign Application Priority Data

Oct. 1, 2007 (GB) ..... 0719115.8

(51) Int. Cl.
*C23C 8/10* (2006.01)
*C23C 1/54* (2006.01)
*C23C 22/54* (2006.01)

(52) U.S. Cl.
USPC ..... 148/277; 148/281; 148/284; 148/668; 148/669; 148/670; 148/675; 148/676

(58) Field of Classification Search ..... 148/277, 148/281, 284, 668–670, 675–676
See application file for complete search history.

(56) References Cited

U.S. PATENT DOCUMENTS

| | | | |
|---|---|---|---|
| 5,709,021 | A | 1/1998 | DiCello et al. |
| 6,799,357 | B2 | 10/2004 | Webb et al. |

FOREIGN PATENT DOCUMENTS

| | | | |
|---|---|---|---|
| JP | 02-037912 | * | 2/1990 |
| JP | 2-37912 | A | 2/1990 |
| JP | 6-79340 | A | 3/1994 |
| JP | 8-112614 | A | 5/1996 |
| JP | 10-17963 | A | 1/1998 |
| JP | 10-137835 | A | 5/1998 |
| JP | 2001-96307 | A | 4/2001 |
| JP | 2001-183239 | A | 7/2001 |
| JP | 2001-187984 | A | 7/2001 |
| JP | 2001-283847 | A | 10/2001 |
| JP | 2004-344950 | A | 12/2004 |
| WO | WO-03/024639 | A1 | 3/2003 |

* cited by examiner

*Primary Examiner* — Lois Zheng
(74) *Attorney, Agent, or Firm* — RatnerPrestia

(57) ABSTRACT

Shape Memory Alloy tube is protected from damage during drawing, caused by galling-type interaction between the tube and high-carbon dies, by forming an oxide surface layer. This invention protects the tube internal diameter from oxidation while allowing the tube outside diameter to be oxidized, by using an oxygen getter located within the tube during the oxidation step. The method yields a higher quality internal diameter and improves productivity.

8 Claims, 4 Drawing Sheets

MANUFACTURING SHAPE MEMORY ALLOY TUBES BY DRAWING

CROSS-REFERENCE TO RELATED APPLICATIONS

This application is the U.S. National Phase application of PCT International Application No. PCT/GB2008/050871, filed Sep. 26, 2008, and claims priority of British Patent Application No. 0719115.8, filed Oct. 1, 2007, the disclosures of both of which are incorporated herein by reference in their entirety for all purposes.

FIELD OF THE INVENTION

The present invention concerns improvements in manufacturing, more especially improvements in manufacturing shape memory alloy (SMA) tubing.

BACKGROUND OF THE INVENTION

There is a considerable commercial interest in SMA tubing, which has many technical uses, including many uses in medical implants or medical device components. The SMA of prime interest for the present invention is a nickel-titanium alloy, generically known as "Nitinol" (or NiTi). Throughout the present description and claims this single name will be used, but it is to be understood that included within the invention are all the binary, tertiary or more complex nickel-titanium alloys having desirable shape memory properties. That is, the application of the invention is not limited to any specific NiTi SMA formulation.

In the formation and size reduction of tubing, one method is to draw the tubing through a series of conical converging dies, in combination with a series of mandrels inserted in the tube internal diameter ("ID"), in order to achieve decreasing tubing outer and inner diameters. Most commonly, the dies are made from a hard material, such as a metal carbide or synthetic or natural diamond. However, the combination of such dies and a oxide free NiTi surface can cause a phenomenon known as "galling", or surface erosion and scratching, due to the particular affinity of the Ti in the NiTi for the carbon in the metal carbide or diamond dies. In extreme cases, galling can cause destruction of an expensive die and process interruption.

The Nitinol industry has developed methodology to minimise or overcome the problem of galling. This uses oxidation of the surface of the Nitinol to form a surface layer of $TiO_2$, of thickness in the range of, usually, 600 to 3000 Angstrom (60 to 300 nanometre), which combined with conventional drawing lubricants, eliminates galling and results in successful diameter reduction and a reasonable die lifetime. The oxide may be formed by heat treating in an atmosphere that contains oxygen such as air or a controlled combination of inert gas with ppm levels of oxygen in the range of 50-1000 ppm. The rapid strain hardening rate and commensurate decrease in ductility of NiTi requires frequent annealing during the tube manufacturing process. It is desirable that the annealing and surface oxidation treatments be accomplished simultaneously. When performing the annealing heat treatment in air, the rate of oxidation may be so rapid that an excessive surface oxide forms. Therefore a controlled oxygen level created by blending ppm levels of oxygen with inert gases is preferred. In this manner, temperatures required for annealing may be attained without excessive oxidation.

The very rapid strain hardening rate and commensurate decrease in ductility of Nitinol does not readily permit the formation of seamless tube by the deep draw method. The preferred method is to drill a central hole in a centerless ground rod to produce the desired wall thickness or OD/ID ratio (outside diameter/internal diameter). The centerless ground OD and drilled/honed ID provide optimum surface conditions for initiating the tube drawing process.

SUMMARY OF THE INVENTION

We have realised that the material suitable for ID mandrels does not require the same extremely high carbon contents as do die materials nor do they experience the same degree of friction force against the NiTi tube material during the drawing process. Accordingly, the initial tubing does not actually require the formation of an internal oxide layer to prevent galling. The internal diameter of the tube and the outside diameter of the mandrel, each having a high quality smooth surface, and in combination with a conventional tube drawing lubricant, permits relatively easy separation of tube from mandrel. Accordingly, the present invention provides a simple and inexpensive process improvement, with a number of benefits in product quality, productivity and environmental issues.

The present invention provides a method for the size reduction by drawing, of an SMA tube, especially of Nitinol, comprising the protection of the tube from galling caused by a die by forming a OD surface oxide layer, wherein the tube inner surface is protected from oxidation during the heating used to produce the desired OD oxide, which conveniently simultaneously anneals the tube material, using sacrificial or reusable oxygen getters.

BRIEF DESCRIPTION OF THE DRAWINGS

The invention will be further described by reference to the figures in which.

DETAILED DESCRIPTION OF THE INVENTION

Figure 1:
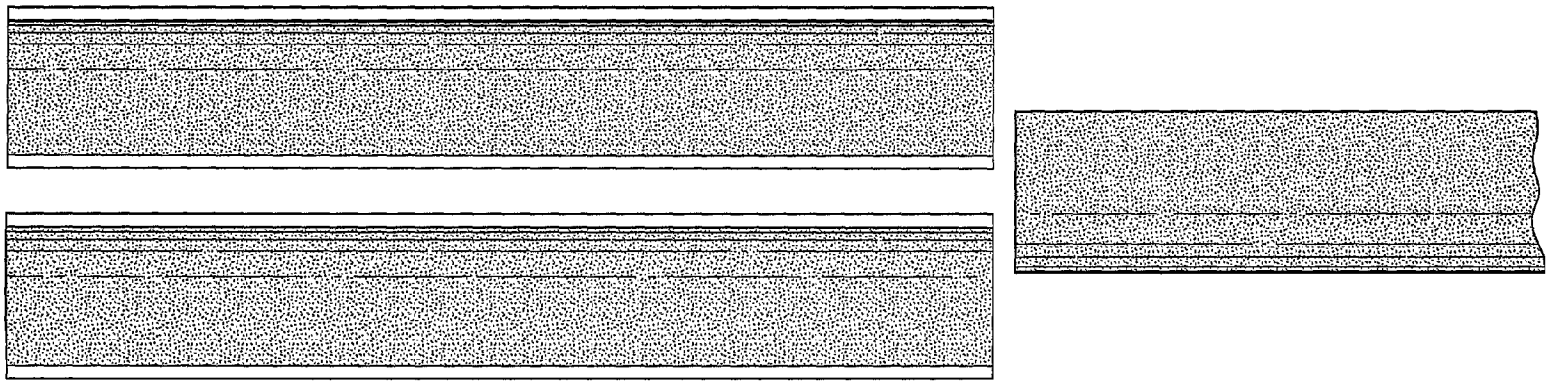
FIG. 1 Prior Art
FIG. 1 shows a comparative example of a Nitinol tube heat treated in a conventional manner.

The skilled person will realise that such oxygen getter means, appropriately sized, will getter all or substantially all of the oxygen passing into the tube internal diameter, when using conventional low ppm oxygen/inert gas combinations.

Suitably, the present invention is carried out by inserting a plug of readily oxidisable material at each end of the tube, and located therein. The plug should preferably be porous so that the atmosphere used during heat treatment may pass through, whilst at the same time being depleted in oxygen. A suitable porous plug may be constructed as a woven sheet of oxygen getter material which is then formed into the plug. The resulting high surface area plug has been found to be highly effective. Other porous getter plugs may be formed from compacted powdered getters.

The use of a porous plug becomes more difficult as ID's decrease, and an alternative is to use a coil of getter wire extending throughout the length of the Nitinol tube. Such a coil may be formed from getter wire, having an external coil diameter somewhat smaller than the ID of the Nitinol tube, for example approx 0.001 inch (0.0254 mm) smaller in diameter than the tube, and a coil length slightly longer than that of the Nitinol tube. The coil can be readily inserted into the tube by stretching it and then releasing it, allowing it to recover to its original coiled position within the tube. Initial tests have demonstrated that the high surface area coil is so effective that the method of the invention works even while heat treating the tube in air.

A variant of the above coil spring embodiment is to use a Nitinol wire coil, where the Nitinol alloy has a transformation temperature above room temperature, say 50° C. or above. The coil can then be stretched into a shape convenient for insertion into the tube, inserted into the tube, then the coil is heated above the transition temperature and wire heated above the transition temperature, causing the coil to return to its original shape within the tube. This offers a high surface area coil with substantially equal oxidation characteristics to the tube ID. After oxidation of the outer surface of the tube, the Nitinol coil can be stretched once more and removed. Such a coil may be reused after acid-etching oxide layer from its surface to restore its oxygen getter ability.

Other suitable oxygen getter materials for use in the present invention are certain ferrous alloys such as the Fe—Cr—Al alloy "Kanthal" and/or titanium/titanium alloys, providing that the getter material has a high affinity for oxygen, does not provide a source of contamination, has a melting point greater than the annealing temperature and does not bind to the inner surface of the tube during the heat treatment/annealing. Many other getter materials may be suggested by the skilled person.

The present invention has been shown to operate well in a number of initial tests.

The present invention potentially offers benefits in combination with the method of manufacturing Nitinol tubes described in U.S. Pat. Nos. 5,709,021 and 6,799,357 which use a soft removable core manufactured from a shape memory alloy. The initial stages of manufacture follow conventional tube over mandrel procedures down to the point of inserting the soft martensitic alloy mandrel cores. Use of the current invention technology will result in clean smooth ID surfaces that will readily accept the martensitic core mandrels and be subsequently readily removed at final tube sizes. In such a method, after traditional drawing, the tube IDs are cleaned and/or etched to remove contaminants such as oil, particulate and oxide debris. The cleaning is time-consuming, and therefore costly, and it is difficult to inspect the tubes non-destructively to ensure thorough cleaning. The present invention offers improved ID surface conditions and cleanliness prior to insertion of the soft core. This may avoid ID surface abnormalities caused by debris being trapped between tube ID and soft mandrel during further drawing and size reduction.

It is believed, therefore, that the present invention reduces or eliminates the need to use highly acid etchants, with consequential savings in material and processing costs, and reducing potential environmental health problems or dangers. The avoidance of acid etching itself reduces surface defects caused by the acid etchant. The improved ID surface quality also reduces friction between Nitinol tube ID and mandrel OD, which can offer an increase in product tube length during drawing. Other benefits from, and methods of operating within, the present invention will be clear to the skilled person.

EXAMPLES

The invention is illustrated by the following Examples, with reference to the accompanying images.

Example 1

Comparison

A Nitinol tube was heat treated in the conventional manner, such that an oxide layer forms on both the tube OD and ID. Sectioning the tube shows no difference between the ID surface and OD surface, as shown in FIG. 1.

Example 2

Figure 2:
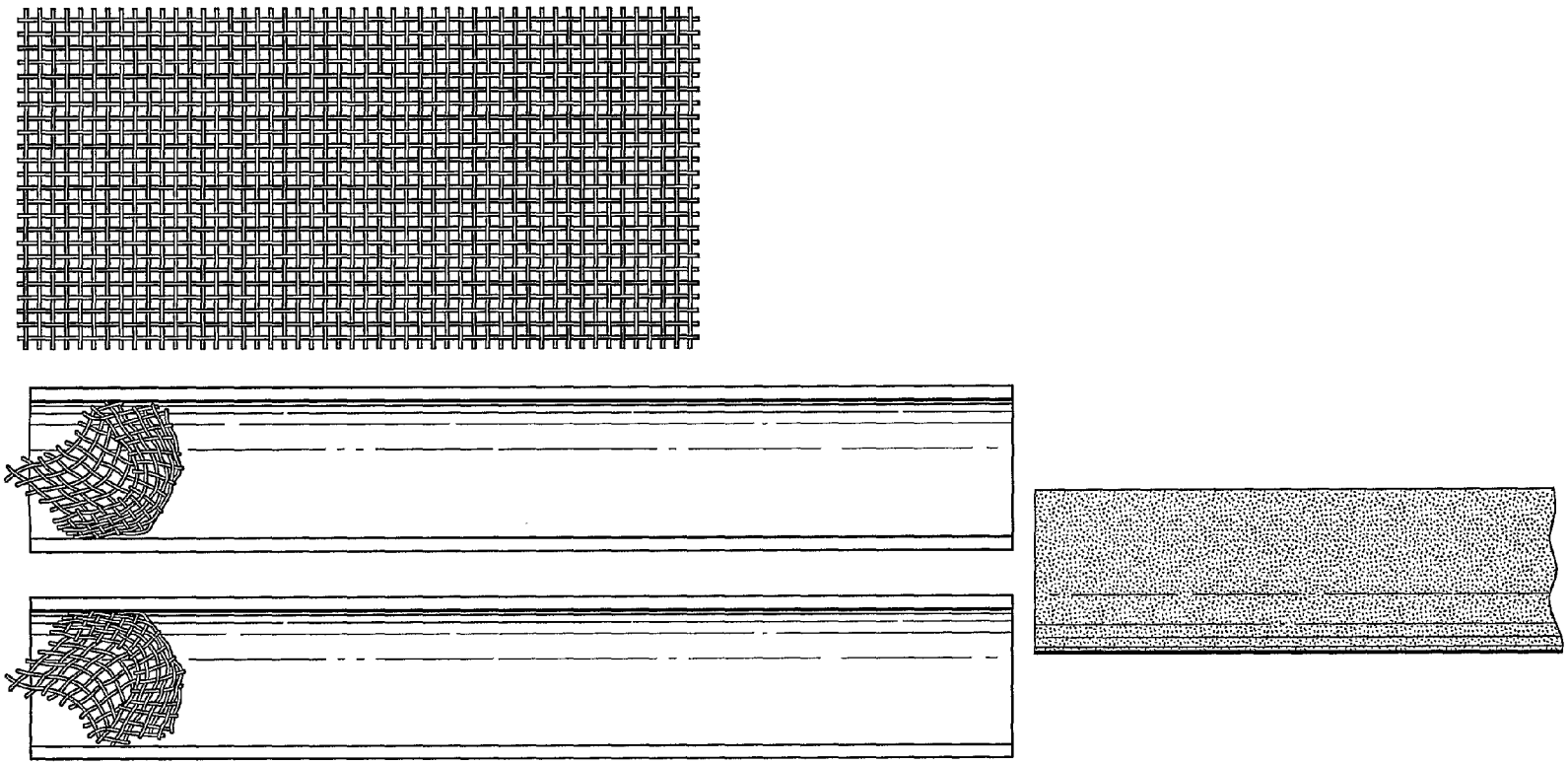
FIG. 2 shows an embodiment according to the invention with the outer diameter having an oxide layer and the inner diameter is protected with mesh plugs as oxygen getter means.

Pieces of a woven Kanthal screen of 24 mesh and nominal composition 22 Cr, 4 Al, balance Fe, as shown in FIG. 2, were wound to give mesh plugs, which were inserted in the ends of a Nitinol tube. The tube was heat treated in the same manner as Example 1, then an end of the tube was sectioned. FIG. 2 shows that the tube ID remains bright, with no oxide formation, whereas the tube OD carries an oxide layer.

Example 3

Figure 3:
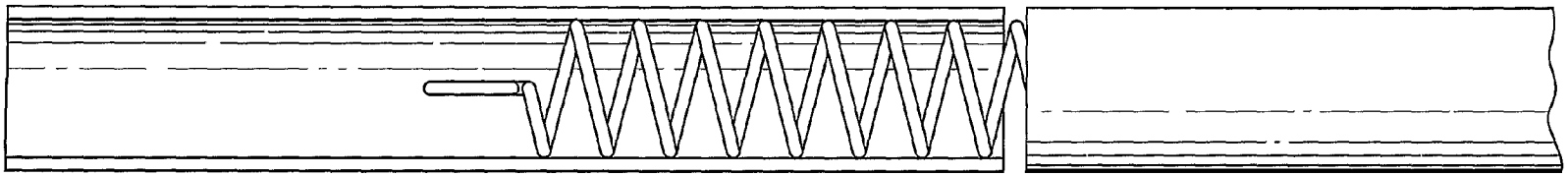
FIG. 3 shows another embodiment according to the invention with a stretched coil in the tube and acting as the oxygen getter means.
Figure 4:
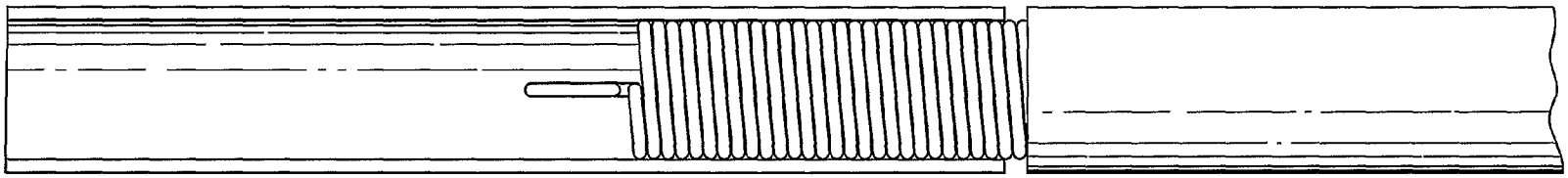
FIG. 4 shows the embodiment according to FIG. 3 where the coil tightly fills the tube.

A Nitinol coil was stretched at room temperature, below its transition temperature, and pulled through a Nitinol tube. The stretched coil is shown clearly in FIG. 3. Heating the coil and tube above the transition temperature of the coil, results in the coil reforming and tightly filling the tube. This is well illustrated in FIG. 4. The coil provides a very large surface area, which is a particularly effective oxygen getter, and protects the tube ID from oxidation, even if heat treatment is carried out in air.

The protected tubes prepared according to the invention have been successfully size reduced using a carbide die for the OD and a soft mandrel together with conventional lubricant for the ID.

The invention claimed is:

1. A method for size reduction by drawing of a shape memory alloy tube comprising forming a surface oxide layer to protect the tube from galling caused by a die, wherein the inner surface of the tube is protected from oxidation during oxidation of the outer surface of the tube, using oxygen getter means.

2. A method according to claim 1, wherein the shape memory alloy tube is Nitinol.

3. A method according to claim 1, wherein the oxygen getter means is a sacrificial or reusable oxygen getter means.

4. A method according to claim 3, wherein the oxygen getter means is formed from a readily oxidizable metal.

5. A method according to claim 3, wherein the oxygen getter means is in the form of a porous plug inserted in the ends of the tube.

6. A method according to claim 5, wherein the plug is formed from a wire mesh or non-woven compact.

7. A method according to claim 3, wherein the oxygen getter means comprises a coil inserted within the tube.

8. A method according to claim 7, wherein the coil is formed from a shape memory alloy, and is inserted in a stretched form and caused to reform to the coil by heating above the transition temperature of the coil metal.

* * * * *

UNITED STATES PATENT AND TRADEMARK OFFICE

CERTIFICATE OF CORRECTION

PATENT NO. : 8,444,775 B2
APPLICATION NO. : 12/680945
DATED : May 21, 2013
INVENTOR(S) : Crombie, III et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 511 days.

Signed and Sealed this
Eighth Day of September, 2015

Michelle K. Lee

Michelle K. Lee
*Director of the United States Patent and Trademark Office*